US007319431B2

(12) United States Patent
Jeon et al.

(10) Patent No.: US 7,319,431 B2
(45) Date of Patent: Jan. 15, 2008

(54) SURFACE MOUNT ANTENNA APPARATUS HAVING TRIPLE LAND STRUCTURE

(75) Inventors: Chan Ik Jeon, Suwon-si (KR); Gun Sung Jang, Seoul (KR)

(73) Assignee: Partron Co., Ltd., Gyeonggi-do (KR)

( * ) Notice: Subject to any disclaimer, the term of this patent is extended or adjusted under 35 U.S.C. 154(b) by 19 days.

(21) Appl. No.: 11/445,953

(22) Filed: Jun. 2, 2006

(65) Prior Publication Data

US 2007/0040749 A1 Feb. 22, 2007

(30) Foreign Application Priority Data

Jun. 3, 2005 (KR) ..... 10-2005-0047908

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 767, 846, 848, 873, 829
See application file for complete search history.

(56) References Cited

U.S. PATENT DOCUMENTS 5,952,970 A * 9/1999 Kawahata ..... 343/700 MS
6,549,167 B1 * 4/2003 Yoon ..... 343/700 MS
6,965,346 B2 * 11/2005 Sung et al. ..... 343/702
2003/0218573 A1 * 11/2003 Yoo et al. ..... 343/702
2004/0125030 A1 * 7/2004 Sung et al. ..... 343/702
2006/0044191 A1 * 3/2006 Harihara ..... 343/700 MS

* cited by examiner

*Primary Examiner*—Huedung Mancuso
(74) *Attorney, Agent, or Firm*—The Webb Law Firm

(57) ABSTRACT

Disclosed herein is a surface mount antenna apparatus applied to a wireless terminal. The antenna apparatus includes a printed circuit board having a ground pattern, a land structure, and an antenna. The land structure includes a non-grounded area having no ground electrode, first and second land pads formed on opposite ends of the non-grounded area to be connected to ground electrodes, and an input pad formed between the first and second land pads and separated from them. The input pad is spaced apart from the first land pad by a preset interval. The antenna includes first and second ground electrodes formed on the lower surface of a dielectric block to be connected to the first and second land pads, a feeding electrode connected to the input pad, and a radiation electrode formed on some of the side surfaces and the upper surface of the dielectric block. The radiation electrode is connected to at least one of the first and second ground electrodes and the feeding electrode.

8 Claims, 10 Drawing Sheets

SURFACE MOUNT ANTENNA APPARATUS HAVING TRIPLE LAND STRUCTURE

BACKGROUND OF THE INVENTION

1. Field of the Invention

The present invention relates generally to a surface mount antenna apparatus adapted for a wireless terminal and, more particularly, to a surface mount antenna apparatus having a triple land structure, which does not need an additional matching circuit, and is capable of generating a strong electromagnetic field between an antenna and a ground area, thus improving radiation performance.

2. Description of the Related Art

Recently, due to the development of communication and broadcasting technology and the expansion of service, small, cheap, and multi-functional communication terminals and broadcast receivers have been proposed. Thus, antennae used for the communication terminals and broadcast receivers are designed to contribute to the small, cheap, and multi-functional structure. One of the types of antenna that are suitable for reducing the size and cost of a terminal is a chip antenna mounted on a PCB (Printed Circuit Board) using surface mount technology.

In this case, the surface mount technology is a method of mounting a lead of a device to the surface of a PCB using a soldering material or the like, without inserting the lead into a hole of the PCB. A device which is formed to be suitable for this mounting method is called an SMD (Surface Mount Device).

Such a surface mount antenna is mounted on a land structure which is formed on a PCB. Thus, in order for the antenna to have proper efficiency at a corresponding terminal, radiation characteristics of the antenna itself, electromagnetic characteristics between the antenna and the land structure, and impedance matching between the antenna and a reception circuit must be appropriately set.

Herein, an apparatus including a PCB, a land structure, and an antenna is defined as an antenna apparatus.

FIG. 1 is a perspective view of a conventional surface mount antenna apparatus, and FIG. 2 is a view showing a land structure of the conventional surface mount antenna apparatus. The conventional surface mount antenna apparatus will be described with reference to FIGS. 1 and 2.

As shown in FIGS. 1 and 2, a PCB 10 is divided into a ground electrode 11 and a non-grounded area 12, and an antenna 20 is mounted on the non-grounded area 12.

In order to stably mount the antenna 20 on the non-grounded area 12, two land pads LP1 and LP2, to be connected to two pads which are provided on the lower surface of the antenna 20, are provided on the non-grounded area 12. The land pads LP1 and LP2 are provided at positions corresponding to the two pads provided on the lower surface of the antenna 20 in such a way as to be spaced apart from the ground electrode 11 by a predetermined interval. In this case, one of the two land pads is connected to a signal line.

Further, the antenna apparatus must be provided with a matching circuit 15 to match impedance between the antenna 20 and a reception circuit, thus preventing signal loss.

In the conventional surface mount antenna apparatus, the antenna mounted on the land structure has a helical structure in order to realize miniaturization, as shown in FIG. 1.

The antenna 20 of FIG. 1 includes a dielectric block 20A having a lower surface, an upper surface, and a plurality of side surfaces. The antenna 20 also includes a feeding electrode 21 and a ground electrode 22 which are provided on the lower surface of the dielectric block 20A. Further, a helical radiation electrode 23 comprising a coil is provided on the upper surface, side surfaces, and lower surface of the dielectric block 20A.

Generally, the helical antenna mounted on the land structure having the two land pads LP1 and LP2 has a ground electrode 11 only at the position where the land pad LP1 connected to the matching circuit 15 is located. In this case, the antenna is operated with a radiation mechanism similar to a mono-pole antenna in a normal operational mode.

Therefore, in the case of having peripheral ground conditions shown in FIGS. 1 and 2, the ground electrode 11 having a spacing distance of $\lambda/8$ or higher of an operating frequency must be provided so as to achieve a radiating efficiency of 50% or higher of the antenna's theoretical potential.

Such an operating principle is understood to be similar to the phenomenon occurring when a dipole or monopole antenna is brought horizontally near a PEC. Thus, in view of the characteristics of the antenna, the non-grounded area 12 must be considerably larger than the antenna. That is, when the non-grounded area 12 is smaller than a preset size, the performance of the antenna is considerably deteriorated. Further, since a radiation unit is provided with the matching circuit for impedance matching, the loss of the antenna may be increased and impedance matching is difficult.

As described above, the conventional surface mount antenna apparatus is constructed so that the antenna 20 mounted on the PCB 10 has a helical structure, and the non-grounded area 12 is much larger than the antenna 20, to an extent such that it is several times as large as the antenna 20, so as to allow the helical antenna apparatus 20 to exhibit efficient performance. Thus, a large space must be secured to mount the antenna 20 on the PCB 10, so that it is difficult to reduce the size of an associated terminal.

Further, since an additional matching circuit 15 is required, the circuit construction is complicated, and manufacturing costs are increased, thus increasing the cost of a terminal having such an antenna apparatus.

SUMMARY OF THE INVENTION

Accordingly, the present invention has been made keeping in mind the above problems occurring in the prior art, and an object of the present invention is to provide a surface mount antenna apparatus having a triple land structure, which is applied to a wireless terminal, and forms the triple land structure on a PCB on which an antenna is mounted, so that an additional matching circuit is not required, and a strong electromagnetic field between the antenna and a ground area can be generated, thus enhancing radiation performance.

In order to accomplish the above object, the present invention provides a surface mount antenna apparatus having a printed circuit board, a land structure, and a chip antenna. The printed circuit board has a ground pattern, and a non-grounded area having a pair of opposite ends defined by the ground pattern. The land structure includes first and second land pads to electrically connect the opposite ends of the non-grounded area to the ground pattern, and an input pad which is formed between the first and second land pads in the non-grounded area to be separated from the first and second land pads, and is arranged to be spaced apart from the first land pad by a preset interval. The chip antenna includes first and second ground electrodes which are formed on a lower surface of a dielectric block and are connected to the first and second land pads, respectively, a feeding electrode which is connected to the input pad, and a radiation electrode which is formed on some side surfaces and an upper surface of the dielectric block and is connected to at least one of the first and second ground electrodes and the feeding electrode.

Each of the first and second land pads is connected to the ground pattern and protrudes in a direction from the ground pattern to the non-contact area.

The input pad is formed to be nearer the first land pad than to the second land pad.

The input pad is formed to be suitable for impedance matching at a use frequency by adjusting a spacing interval between the input pad and the first land pad to change mutual inductance and/or capacitance.

The input pad is connected to a signal line.

The first ground electrode of the chip antenna may be independent of the feeding electrode, or may be integrally connected to the feeding electrode.

The radiation electrode of the chip antenna is directly connected to at least one of the first and second ground electrodes and the feeding electrode.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
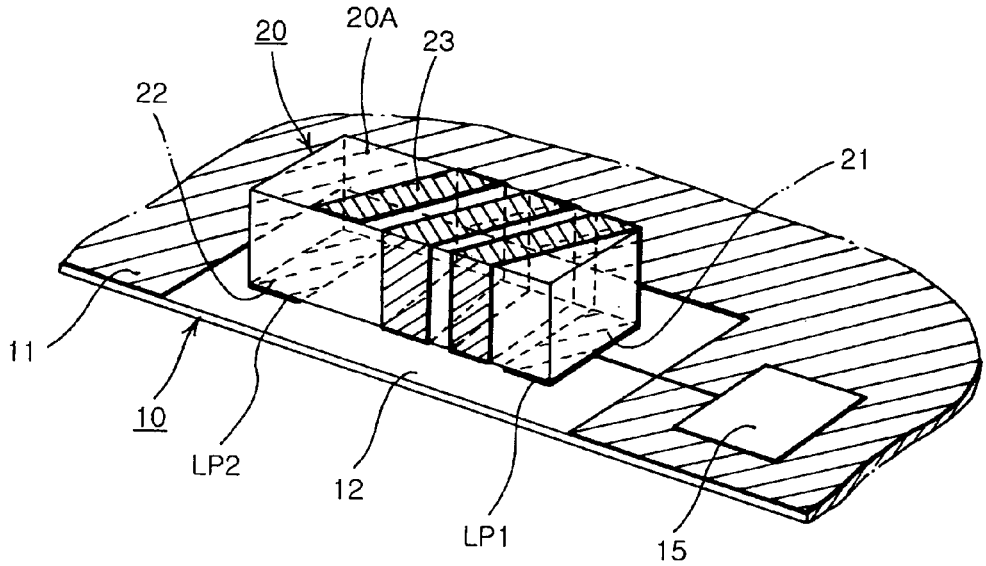
FIG. 1 is a perspective view of a conventional surface mount antenna apparatus.
Figure 2:
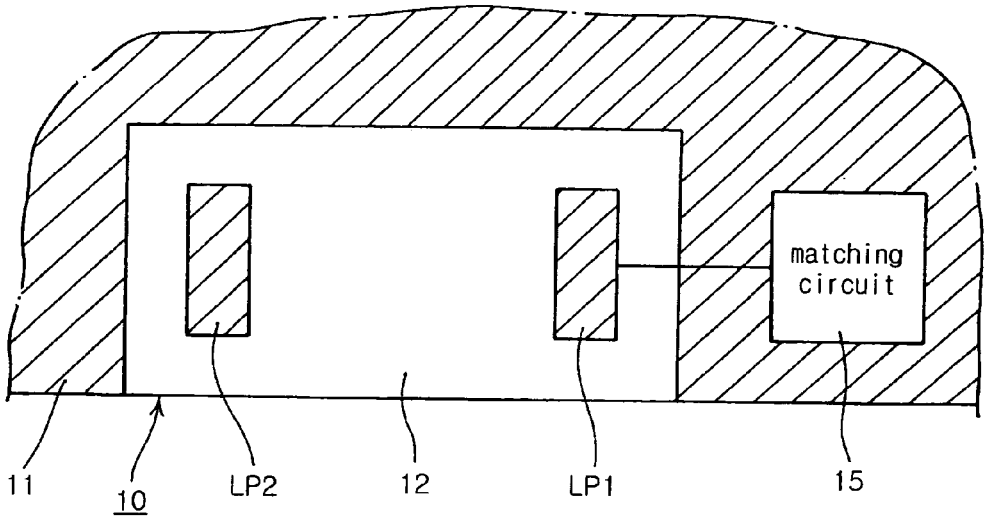
FIG. 2 is a view showing a land structure of the conventional surface mount antenna apparatus.

Reference now should be made to the drawings, in which the same reference numerals are used throughout the different drawings to designate the same or similar components.

Figure 3:
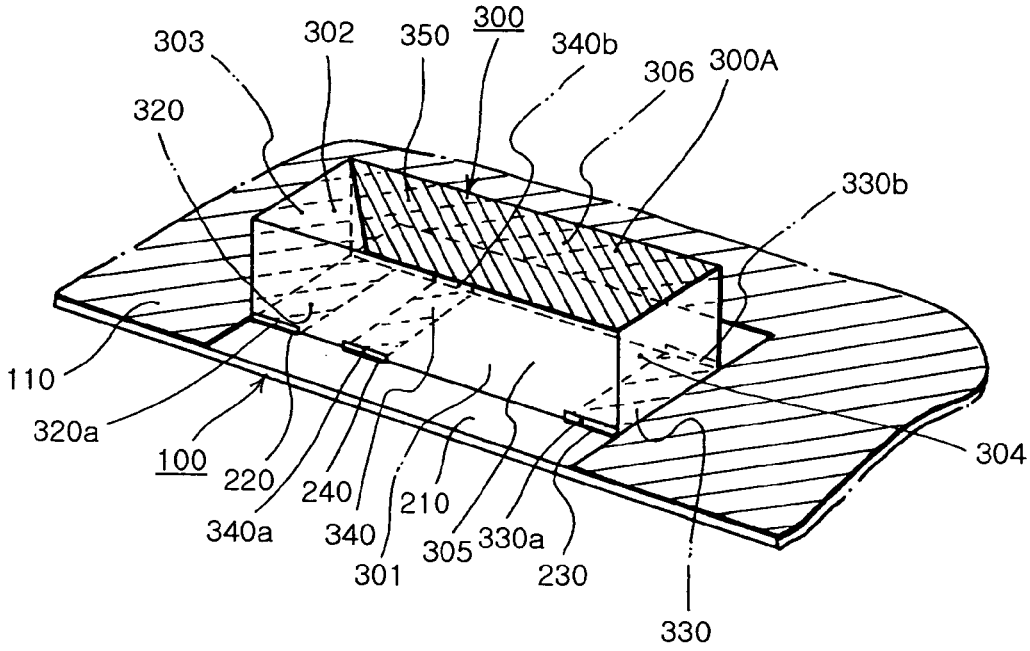
FIG. 3 is a perspective view of a surface mount antenna apparatus, according to the present invention.
Figure 4:
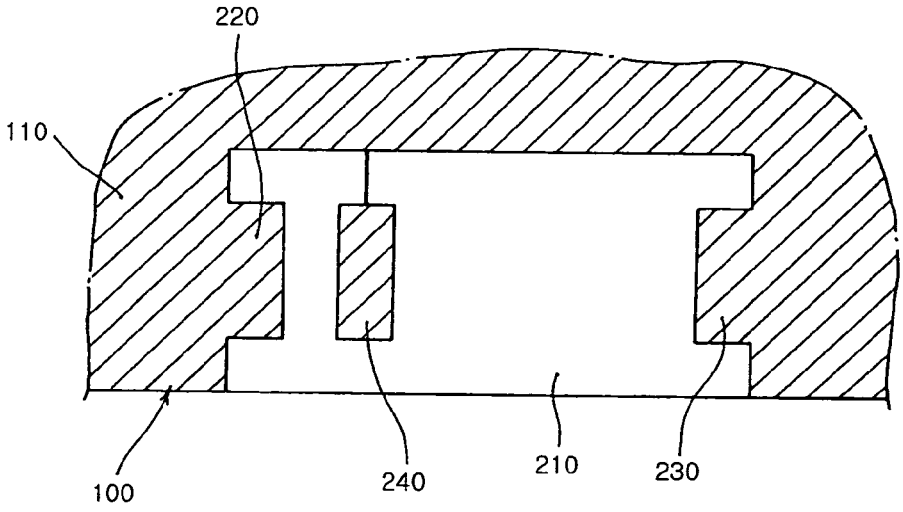
FIG. 4 is a view showing a land structure of the surface mount antenna apparatus, according to the present invention.

FIG. 3 is a perspective view of a surface mount antenna apparatus, according to the present invention, and FIG. 4 shows the first embodiment of a land structure of the surface mount antenna apparatus of FIG. 3.

Referring to FIGS. 3 and 4, the surface mount antenna apparatus according to this invention includes a PCB 100, a land structure, and an antenna 300. In this case, a ground pattern 110 is formed on an area of the PCB 100 other than the area where the antenna 300 is mounted.

The land structure provides a structure for mounting the antenna 300 on the PCB 100. The land structure includes a non-grounded area 210 having no ground pattern 110, first and second land pads 220 and 230, and an input pad 240. The first and second land pads 220 and 230 are provided on opposite ends of the non-grounded area 210 in such a way as to be connected to the ground pattern 110. The input pad 240 is provided between the first and second land pads 220 and 230 to be separated from the first and second land pads 220 and 230, and is spaced apart from the first land pad 220 by a preset interval. In this case, the input pad 240 is connected to the ground pattern 110 via a signal line.

As such, the land structure of the surface mount antenna apparatus according to the present invention is a triple land structure where the first land pad 220, the input pad 240, and the second land pad 230 are sequentially arranged.

Further, the antenna 300 includes first and second ground electrodes 320 and 330, a feeding electrode 340, and a radiation electrode 350. The first and second ground electrodes 320 and 330 are provided on a lower surface 301 of a dielectric block 300A, and are connected to the first and second land pads 220 and 230, respectively. The feeding electrode 340 is connected to the input pad 240. The radiation electrode 350 is formed on some of the side surfaces 303, 304, 305, and 306, and on an upper surface 302 of the dielectric block 300A, and is connected to at least one of the first ground electrode 320, the second ground electrode 330, and the feeding electrode 340.

Figure 5:
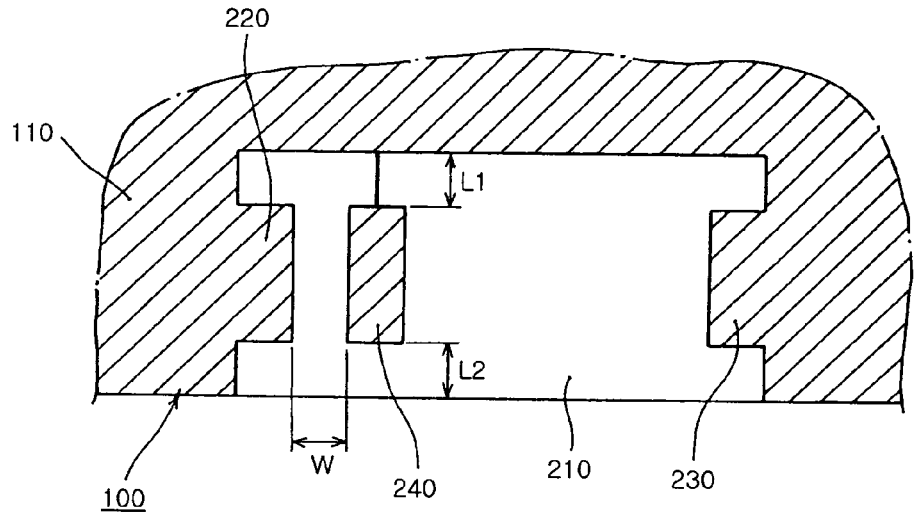
FIG. 5 is a view illustrating the land structure of the present invention.

FIG. 5 is a view to illustrate the land structure of FIG. 4. Referring to FIGS. 3 to 5, the respective first and second land pads 220 and 230 are connected to the ground pattern 110, and may be formed to protrude in a direction from the ground pattern 110 to the non-grounded area 210.

The input pad 240 is formed to be nearer the first land pad 220, in comparison with the second land pad 230. The input pad 240 is formed to be suitable for impedance matching at a use frequency by adjusting the spacing interval W between the input pad 240 and the first land pad 220 to vary mutual inductance and/or capacitance.

Further, the characteristics of the antenna 300 may be controlled by adjusting the longitudinal distance L1 between the ground pattern 110 and the input pad 240, the first land pad 220, or the second land pad 230, and the longitudinal distance L2 between one end of the PCB 100 and the input pad 240, the first land pad 220, or the second land pad 230.

As such, it is possible to control impedance by adjusting the interval W between the first land pad 220 and the input pad 240, and the distances L1 and L2. Since impedance can be appropriately controlled by the triple land structure itself, an additional impedance matching circuit is not required.

Figure 6:
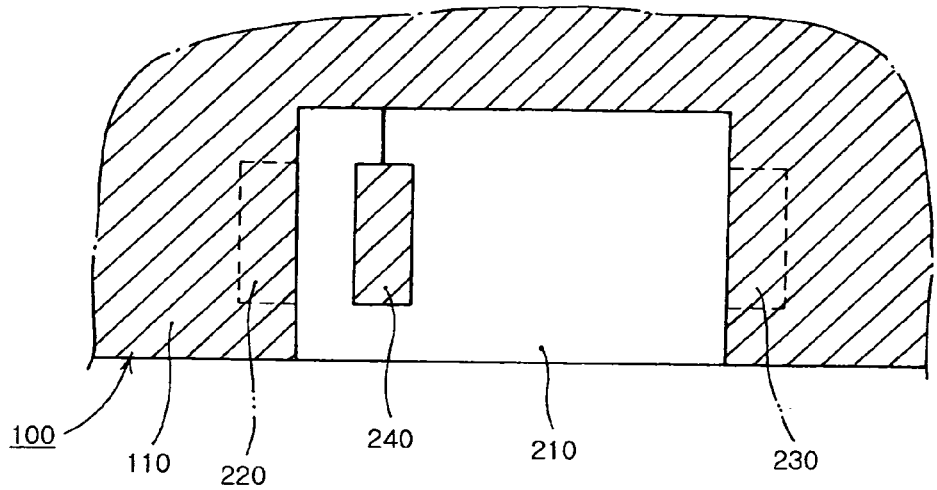
FIG. 6 is a view illustrating a land structure, according to a modification of the present invention.

FIG. 6 shows the second embodiment of a land structure of the surface mount antenna apparatus, according to the present invention. Referring to FIG. 6, the first land pad 220 and the second land pad 230 are connected to the ground pattern 110. The first and second land pads 220 and 230 do not protrude in a direction from the ground pattern 110 to the non-grounded area 210, but may be confined in the ground pattern 110 so that the first and second land pads 220 and 230 are formed at junctions between the ground pattern 110 and the non-grounded area 210.

In a detailed description, the first and second land pads 220 and 230 of the surface mount antenna apparatus, according to the present invention, may be formed in such a way as to protrude from the ground pattern 110 of the PCB 100, as shown in FIG. 4. As an alternative to this configuration, the first and second land pads 220 and 230 do not protrude from the ground pattern 110, but part of the ground pattern 110 may be used as the first and second land pads 220 and 230, as shown in FIG. 6.

Meanwhile, the first ground electrode 320 and the feeding electrode 340 of the antenna 300 may be separated from each other. Alternatively, the first ground electrode 320 and the feeding electrode 340 may be connected and thereby integrated into a single structure. Further, the radiation electrode 350 is connected to at least one of the first ground electrode 320, the second ground electrode 330, and the feeding electrode 340. Various modifications of the antenna 300 are shown in FIGS. 7*a* to 7*e*.

Figure 7A:
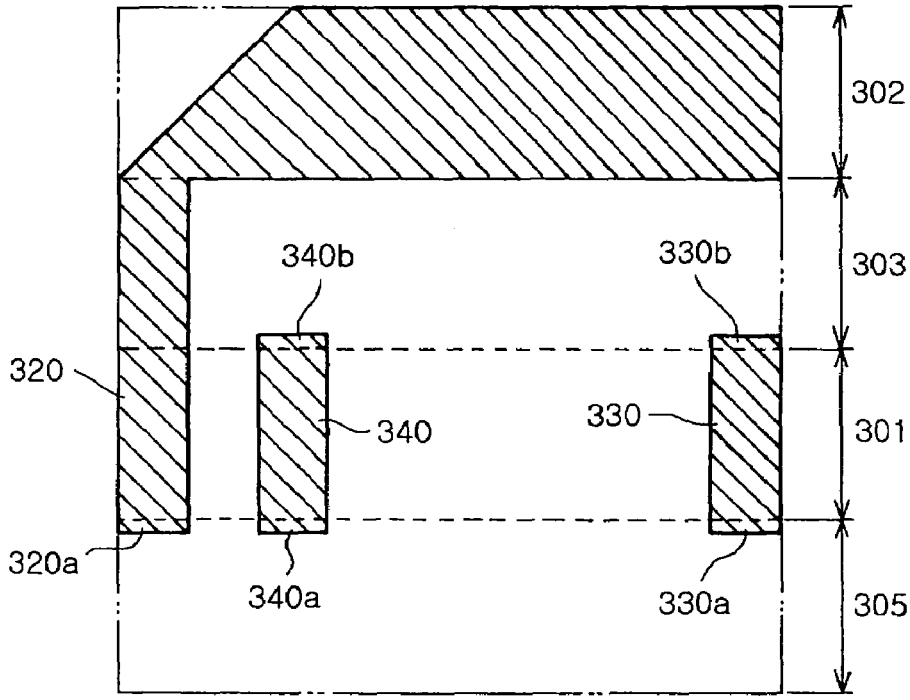
FIGS. 7*a* to 7*e* are development views of the surface mount antenna apparatus, according to the present invention.

FIGS. 7*a* to 7*e* are development views of surface mount antennae 300, according to the present invention. As shown in FIG. 7*a*, the first ground electrode 320 and the feeding electrode 340 may be separated from each other, and the radiation electrode 350 of the upper surface 302 may be connected to the first ground electrode 320.

Figure 7B:
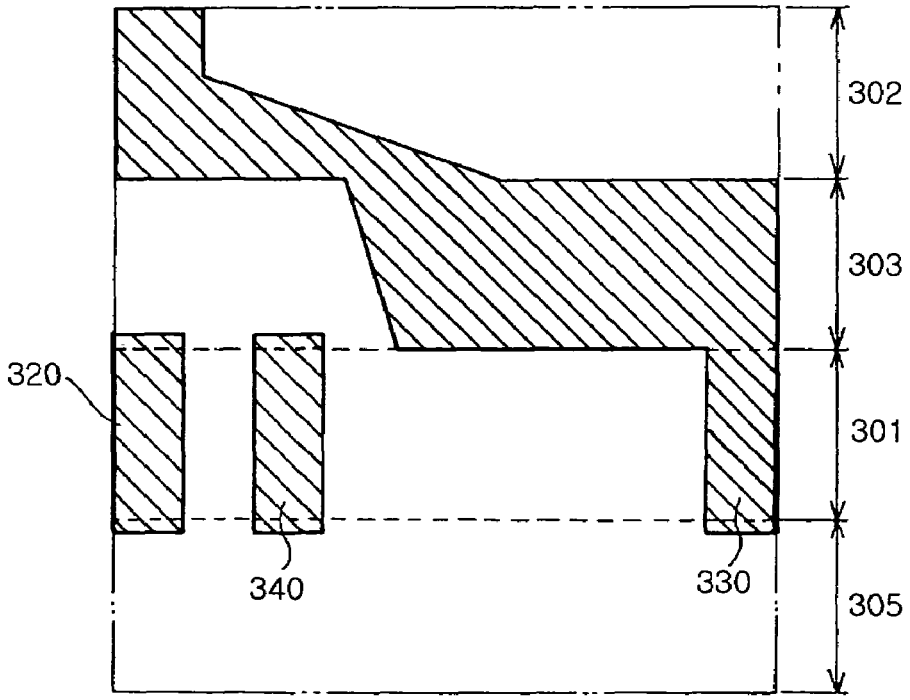

Further, as shown in FIG. 7*b*, the first ground electrode 320 and the feeding electrode 340 may be separated from each other, and the radiation electrode 350 of the upper surface 302 may be connected to the second ground electrode 330.

Figure 7C:
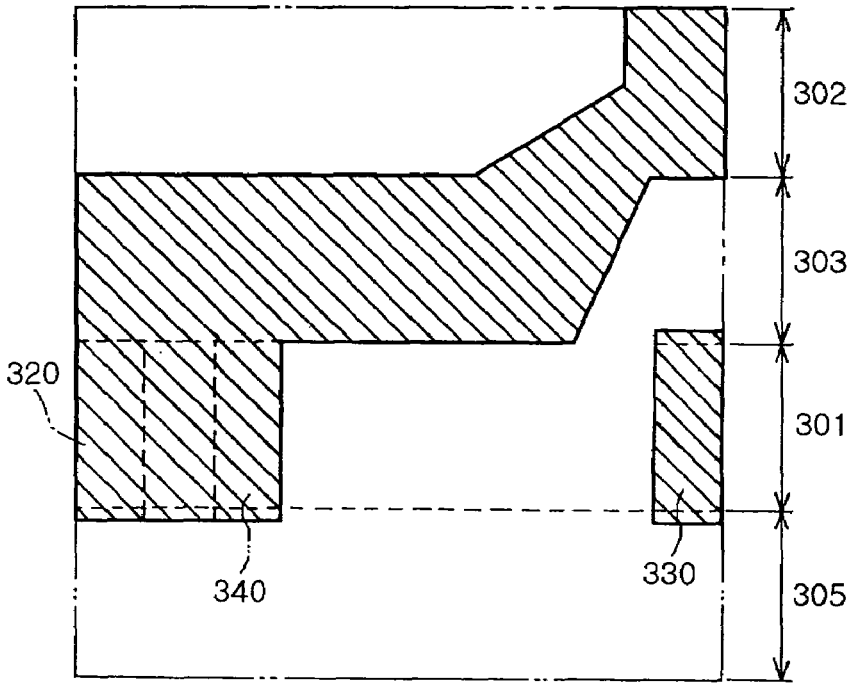

As shown in FIG. 7*c*, the first ground electrode 320 and the feeding electrode 340 may be connected to be integrated with each other, and the radiation electrode 350 of the upper surface 302 may be connected to the first ground electrode 320 and the feeding electrode 340.

Figure 7D:
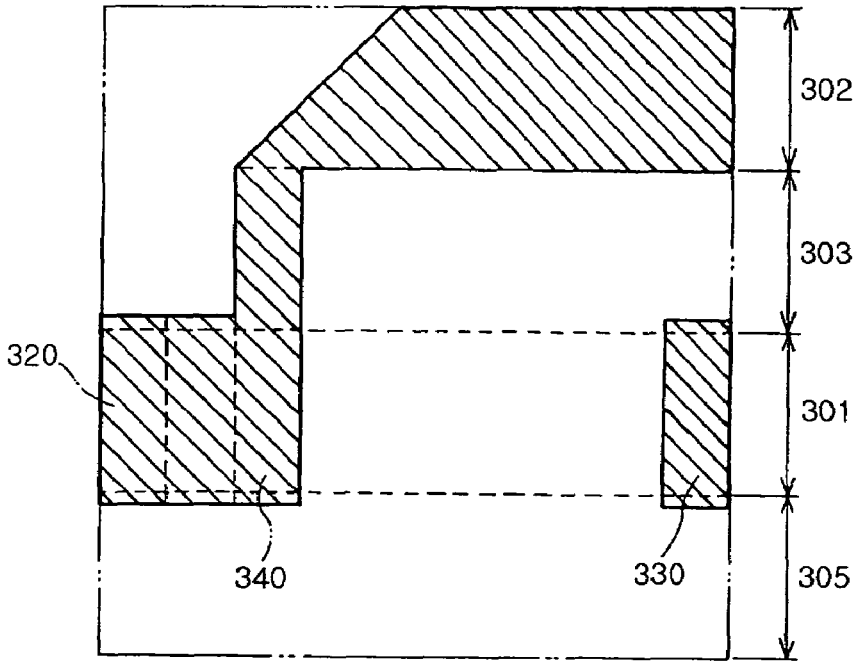

Further, as shown in FIG. 7*d*, the first ground electrode 320 and the feeding electrode 340 may be connected to be integrated with each other, and the radiation electrode 350 of the upper surface 302 may be connected to the feeding electrode 340.

Figure 7E:
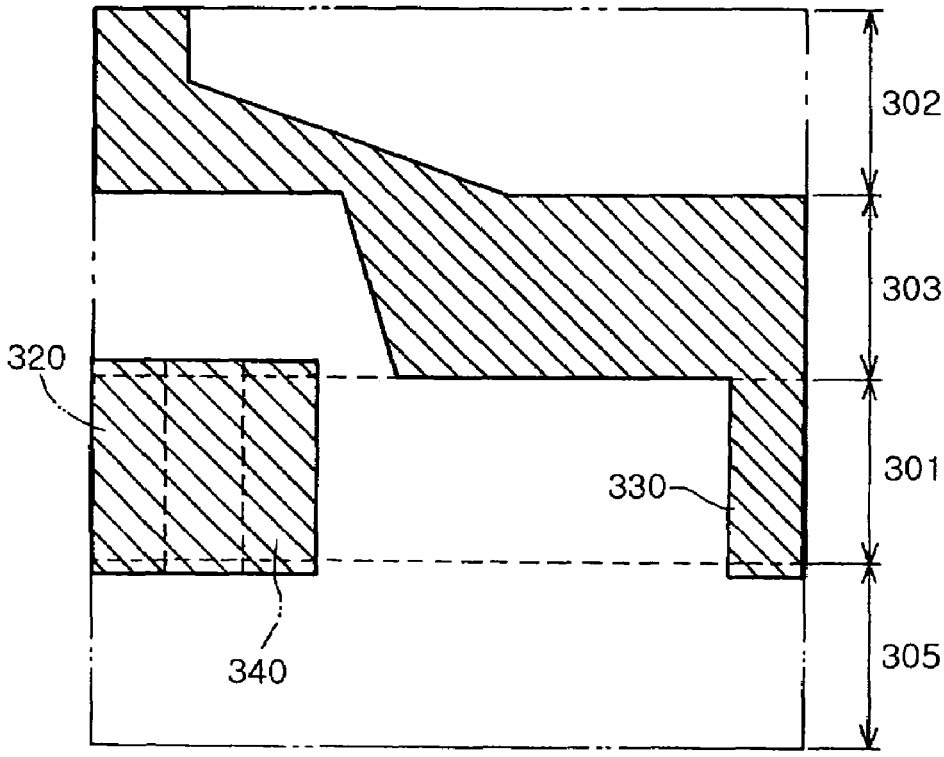

As shown in FIG. 7*e*, the first ground electrode 320 and the feeding electrode 340 may be connected to be integrated with each other, and the radiation electrode 350 of the upper surface 302 may be connected to the second ground electrode 330.

As shown in FIGS. 7*a* to 7*e*, the radiation electrode 350 of the antenna 300 may be provided in various forms.

Referring to FIGS. 3 and 7*a*, in the antenna 300 of the antenna apparatus of this invention, ends of the first ground electrode 320, the second ground electrode 330, and the feeding electrode 340, which are not connected to the radiation electrode 350, extend to the side, thus forming extensions 320*a*, 330*a*, 330*b*, 340*a*, and 340*b*. Adjusting the length of the extensions 320*a*, 330*a*, 330*b*, 340*a*, and 340*b* can help match impedance and control a resonance frequency.

As described above, the present invention uses a new triple land structure for mounting a chip antenna on a PCB, thus reducing the size of the antenna without using a helical structure, and efficiently generating an electromagnetic field between the antenna and a ground electrode, therefore enhancing radiation performance of the antenna.

Further, the land structure of the present invention is capable of reducing the area for mounting the antenna. The antenna apparatus having such a land structure can be applied to a wireless terminal which must have a small size, and the impedance of land pads can be matched with that of ground electrodes, so that an additional impedance matching circuit is not required, thus reducing manufacturing costs of a terminal incorporating the antenna apparatus of this invention.

The above-mentioned surface mount antenna 300 of this invention may be manufactured to have various sizes. When the surface mount antenna 300 of this invention is manufactured to have a size of 6×2×1.2 (length×width×height), the electrical characteristics of the antenna are represented in the following table 1, and FIGS. 8 and 9*a* to 9*c*.

The electrical characteristics of the surface mount antenna 300 according to this invention are represented in the following table 1.

TABLE 1

| ITEM | | | | SPECIFICATION |
|---|---|---|---|---|
| Frequency Range | | | | 2380~2530 MHz |
| Voltage Standing Wave Ratio (VSWR) | | | | 2.0 Max |
| Polarization | | | | Linear |
| Band Width [MHz] | | | | 150 MHz |
| Gain | Azimuth | Theta | Peak | 2.61 |
| | | | Average | −0.18 |
| | | Phi | Peak | −3.59 |
| | | | Average | −7.55 |
| | Elevation 1 | Theta | Peak | 1.65 |
| | | | Average | −2.07 |
| | | Phi | Peak | 4.03 |
| | | | Average | −0.11 |
| | Elevation 2 | Theta | Peak | −13.62 |
| | | | Average | −20.20 |
| | | Phi | Peak | 4.2 |
| | | | Average | 0.89 |

Figure 8:
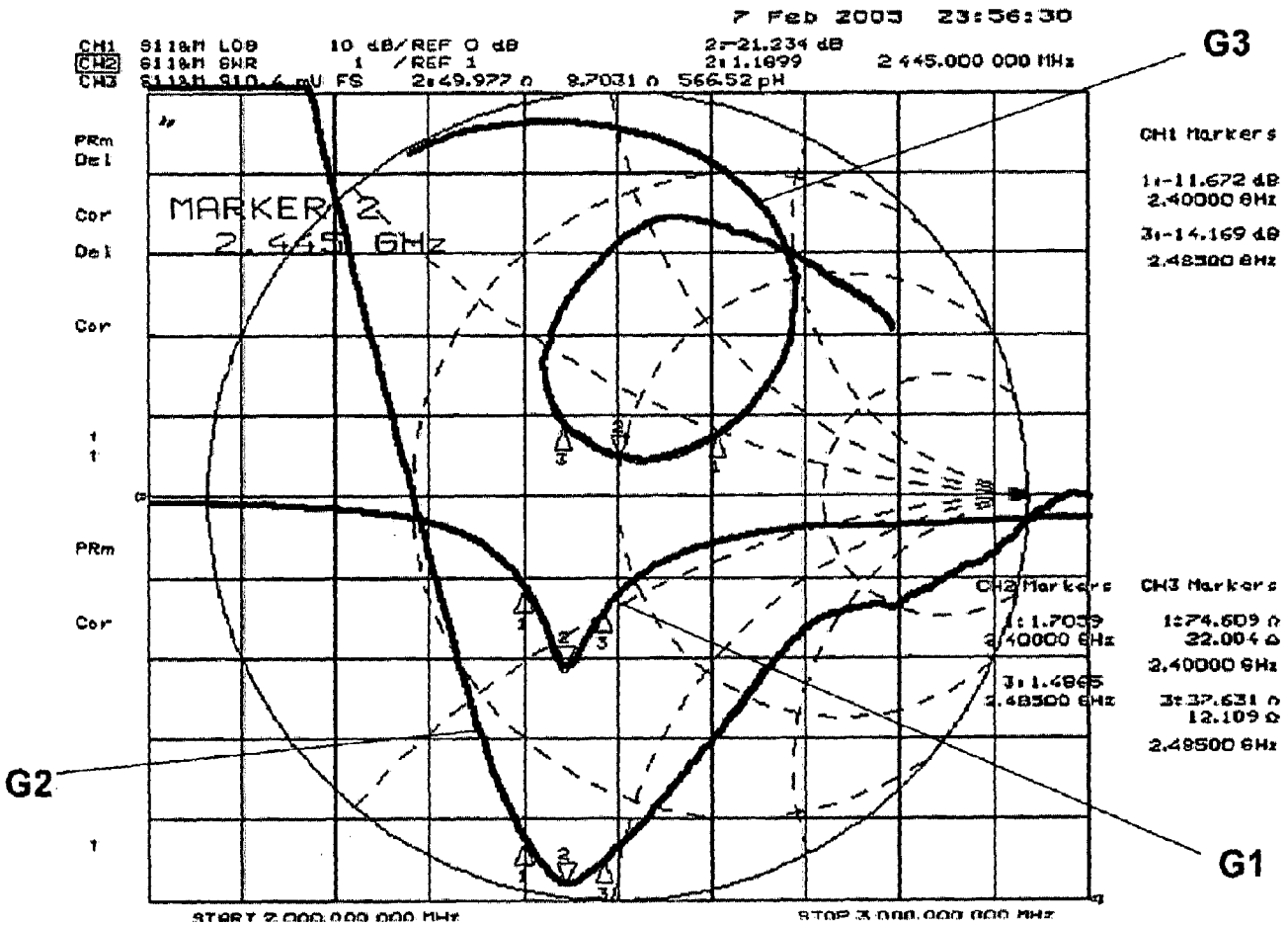
FIG. 8 is a view showing the reflective loss of the surface mount antenna apparatus, according to the present invention.

FIG. 8 is a view showing the reflective loss of the surface mount antenna apparatus, according to the present invention. The abscissa of FIG. 8 designates a frequency from 2 GHz to 3 GHz, and the ordinate of FIG. 8 designates amplitude. The line G1 of FIG. 8 shows the SWR characteristics, and the line G2 is a reflection loss graph wherein the SWR characteristic values are changed to Log values. In the line G2, the lower the line G2 falls, the less the reflection is. Further, the line G3 is a Smith Chart Graph showing the impedance trace of the antenna.

Figure 9A:
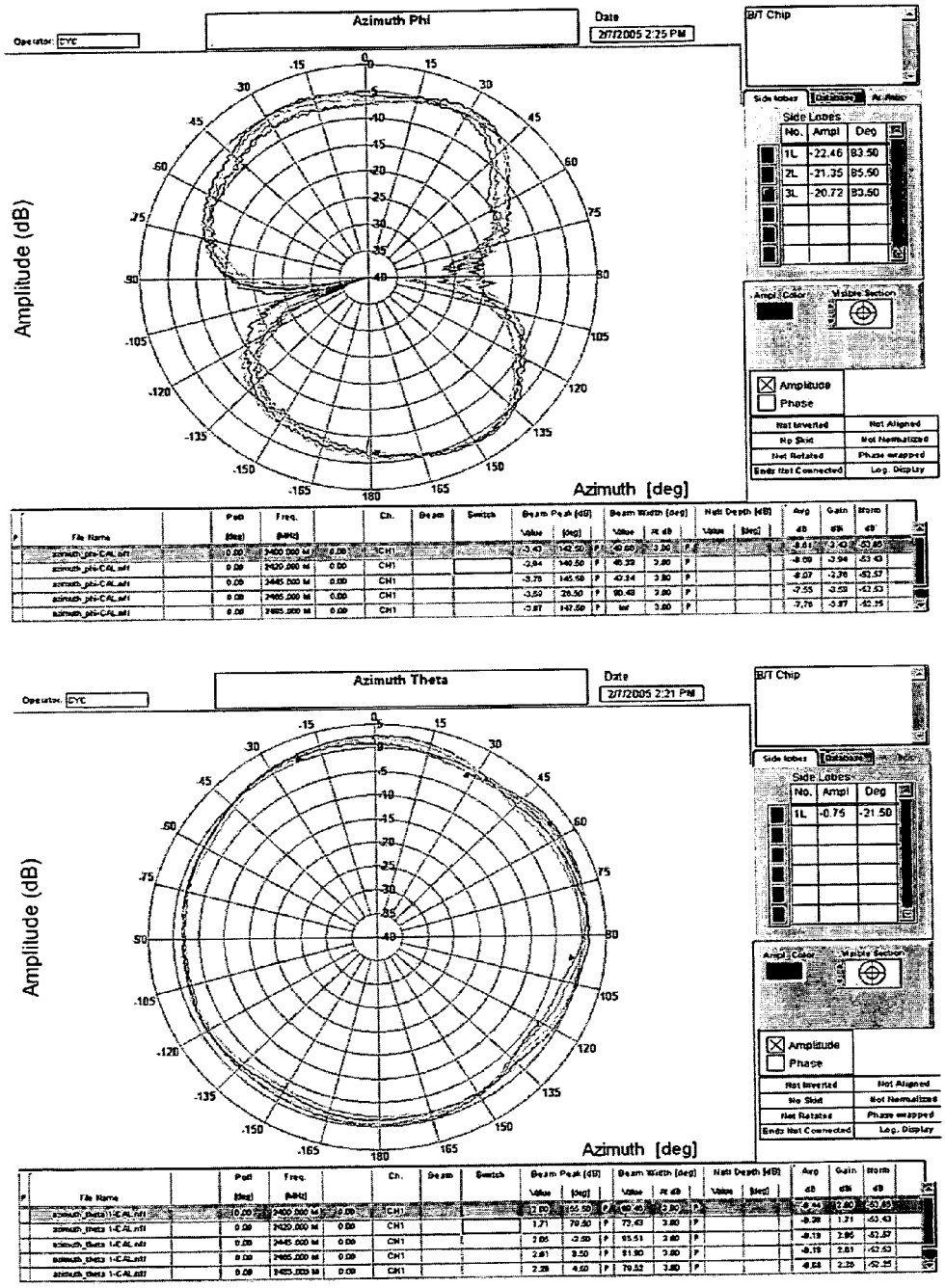
FIGS. 9*a* to 9*c* are diagrams showing the radiation patterns of the surface mount antenna apparatus, according to the present invention.
Figure 9B:
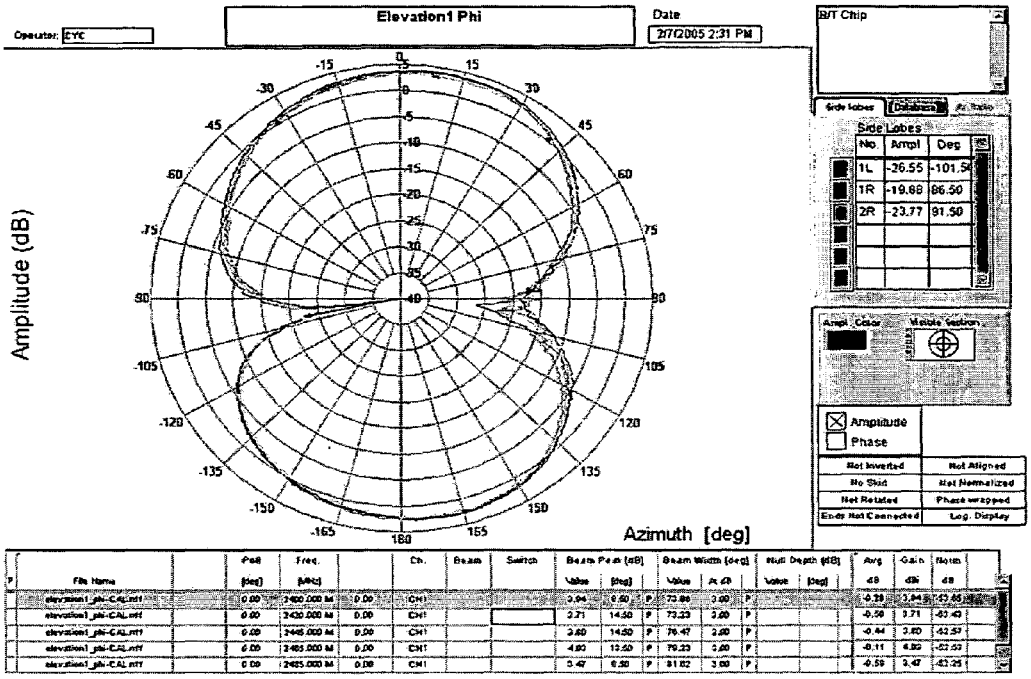
Figure 9B:
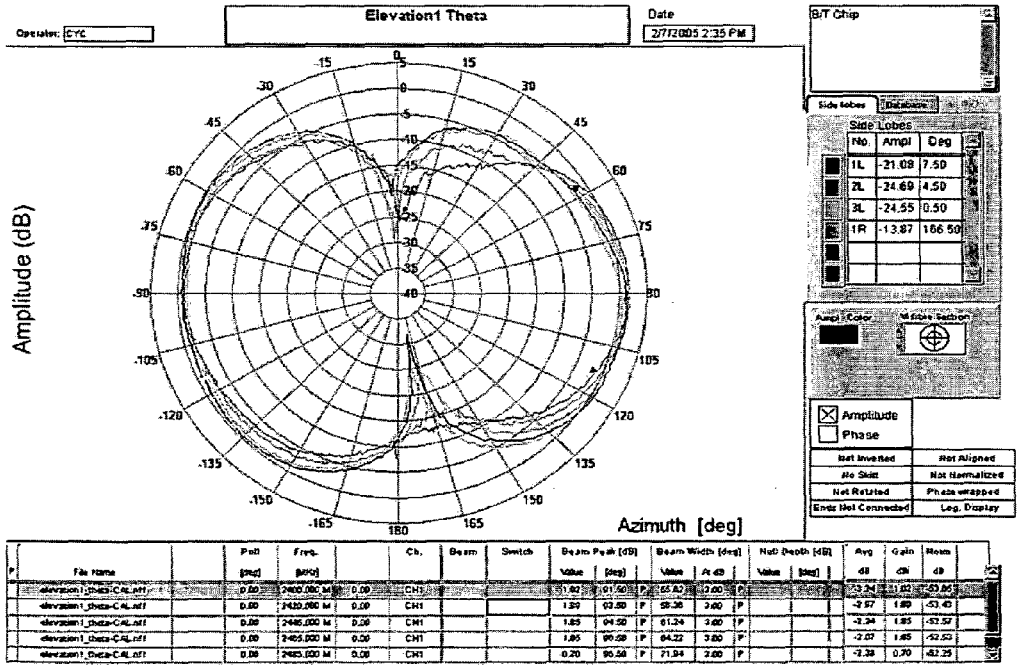
Figure 9C:
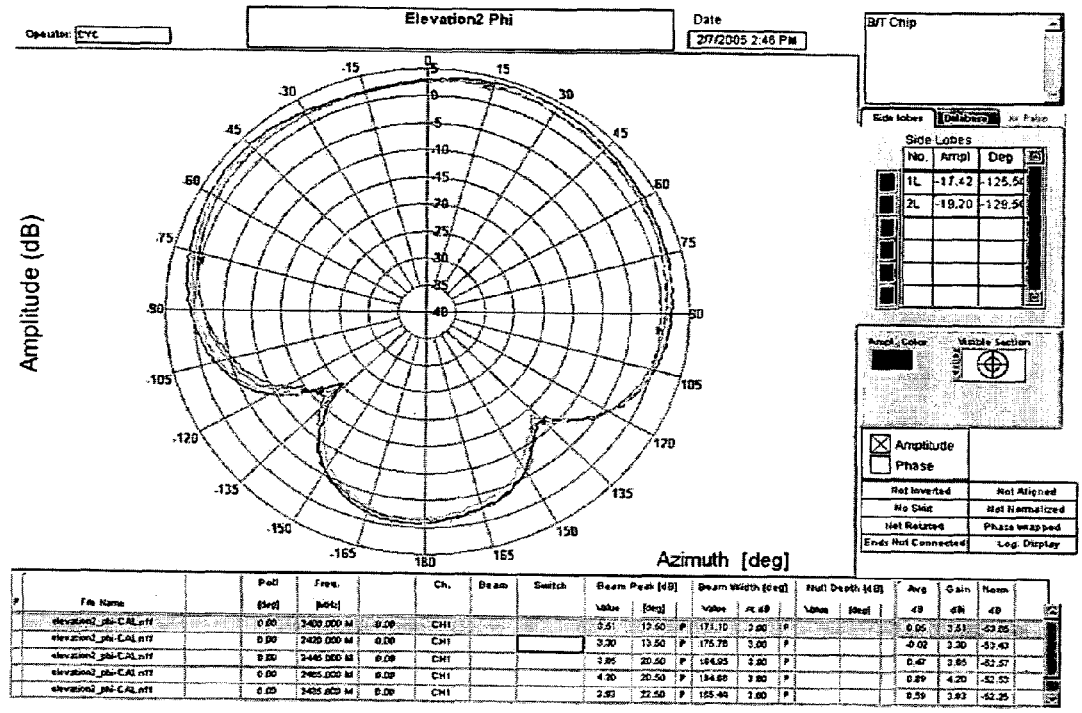
Figure 9C:
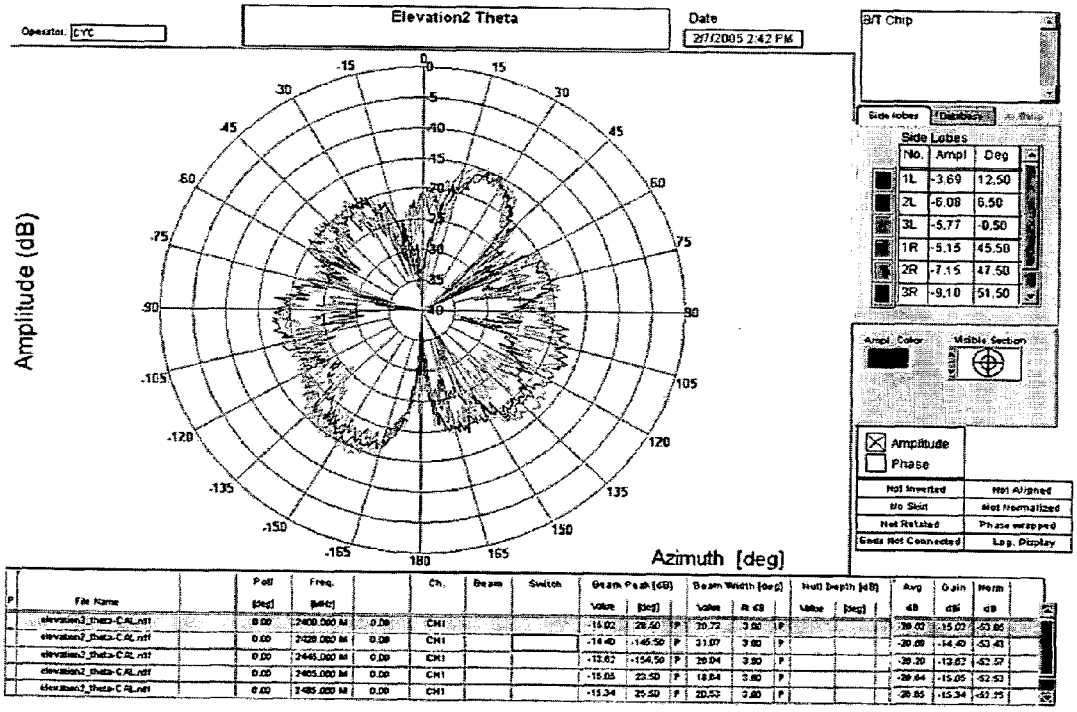

FIGS. 9*a* to 9*c* are diagrams showing the radiation patterns of the surface mount antenna apparatus, according to the present invention. FIG. 9*a* is a diagram showing a radiation pattern corresponding to the azimuth, FIG. 9*b* is a diagram showing a radiation pattern corresponding to the first elevation, and FIG. 9*c* is a diagram showing a radiation pattern corresponding to the second elevation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

As described above, the present invention provides a surface mount antenna apparatus adapted for a wireless terminal, which forms a triple land structure on a PCB on which an antenna is mounted, so that an additional matching circuit is not required because the structure has been changed, and a strong electromagnetic field can be generated between the antenna and a ground area, thus enhancing radiation performance.

What is claimed is:

1. A surface mount antenna apparatus having a triple land structure, comprising:

a printed circuit board, comprising:

a ground pattern; and a non-grounded area having a pair of opposite ends defined by the ground pattern;

a land structure, comprising:

first and second land pads to electrically connect the opposite ends of the non-grounded area to the ground pattern; and an input pad formed between the first and second land pads in the non-grounded area to be separated from the first and second land pads, and arranged to be spaced apart from the first land pad by a preset interval; and a chip antenna, comprising:

first and second ground electrodes formed on a lower surface of a dielectric block, and connected to the first and second land pads, respectively;

a feeding electrode connected to the input pad; and a radiation electrode formed on some side surfaces and an upper surface of the dielectric block, and connected to at least one of the first and second ground electrodes and the feeding electrode.

2. The surface mount antenna apparatus as set forth in claim 1, wherein each of the first and second land pads is connected to the ground pattern and protrudes in a direction from the ground pattern to the non-contact area.

3. The surface mount antenna apparatus as set forth in claim 1, wherein the input pad is formed to be nearer the first land pad than to the second land pad.

4. The surface mount antenna apparatus as set forth in claim 1, wherein the input pad is formed to be suitable for impedance matching at a use frequency by adjusting a spacing interval between the input pad and the first land pad to change mutual inductance and/or capacitance.

5. The surface mount antenna apparatus as set forth in claim 1, wherein the input pad is connected to a signal line.

6. The surface mount antenna apparatus as set forth in claim 1, wherein the first ground electrode of the chip antenna is integrally connected to the feeding electrode.

7. The surface mount antenna apparatus as set forth in claim 1, wherein the radiation electrode of the chip antenna is directly connected to at least one of the first and second ground electrodes and the feeding electrode.

8. The surface mount antenna apparatus as set forth in claim 1, wherein an electrode of the first and second electrodes and the feeding electrode, which is not connected to the radiation electrode, extends at an end thereof to one side, thus providing an extension.

* * * * *